US008979526B2

(12) United States Patent
Cebulski

(10) Patent No.: US 8,979,526 B2
(45) Date of Patent: Mar. 17, 2015

(54) CELL PHONE COVER WITH INTEGRATED CIGARETTE LIGHTER

(71) Applicant: James Cebulski, Crown Point, IN (US)

(72) Inventor: James Cebulski, Crown Point, IN (US)

( * ) Notice: Subject to any disclaimer, the term of this patent is extended or adjusted under 35 U.S.C. 154(b) by 0 days.

(21) Appl. No.: 14/266,167

(22) Filed: Apr. 30, 2014

(65) Prior Publication Data

US 2014/0335462 A1 Nov. 13, 2014

Related U.S. Application Data

(60) Provisional application No. 61/822,647, filed on May 13, 2013.

(51) Int. Cl.
*F23Q 13/00* (2006.01)

(52) U.S. Cl.
CPC ..... *F23Q 13/00* (2013.01)
USPC ..... 431/135

(58) Field of Classification Search
CPC ..... F23Q 7/00; F23Q 7/14; F23Q 7/16; H01T 15/00
USPC ..... 431/125, 135–141; 206/216, 267, 268, 206/270, 260; 361/264, 266
See application file for complete search history.

(56) References Cited

U.S. PATENT DOCUMENTS

| | | | | |
|---|---|---|---|---|
| 4,816,971 | A | 3/1989 | Chin | |
| 7,373,183 | B2 | 5/2008 | Brudos | |
| 7,494,239 | B2 | 2/2009 | Riccardi | |
| 8,014,822 | B1 | 9/2011 | Murray et al. | |
| 2005/0218137 | A1 | 10/2005 | Sela et al. | |
| 2007/0045276 | A1 * | 3/2007 | Fisher et al. | 219/268 |
| 2013/0220847 | A1 * | 8/2013 | Fisher et al. | 206/216 |

* cited by examiner

*Primary Examiner* — Avinash Savani
*Assistant Examiner* — Vivek Shirsat
(74) *Attorney, Agent, or Firm* — Daniel Boudwin; Global Intellectual Property Agency LLC

(57) ABSTRACT

Described is a cell phone cover having an integrated cigarette lighter. The cell phone cover includes a housing that is divided into an interior volume in which a cell phone can be inserted, and an enclosed volume in which a control circuit having a supplemental battery is positioned. A lighting port having a heating element suited for lighting a cigarette and at least one lighting port control are positioned on the housing. The lighting port control allows a user to turn the lighting port on or off and is connected to a control circuit and powered by means of the supplemental battery. The cell phone cover is composed of a heat-resistant material that will not burn or melt as result of the heat created by the lighting port and that protects the cell phone from exposure to the heat created from the lighting port.

16 Claims, 3 Drawing Sheets

CELL PHONE COVER WITH INTEGRATED CIGARETTE LIGHTER

CROSS REFERENCE TO RELATED APPLICATION

This application claims the benefit of U.S. Provisional Application No. 61/822,647 filed on May 13, 2013, entitled "Cell Phone Case E.C.L." The above identified patent application is herein incorporated by reference in its entirety to provide continuity of disclosure.

BACKGROUND OF THE INVENTION

1. Field of the Invention

The present invention relates to a combination cell phone cover and cigarette lighter. More specifically, the present invention provides a cell phone cover having an integrated cigarette lighter, comprising an interior volume in which a cell phone can be positioned and an enclosed volume in which a supplemental battery and a control circuit are positioned. A lighting port comprising a heating element is disposed on the cell phone cover along with at least one lighting port control that can be operated in order to selectively power the lighting port.

In order to light a cigarette, many people use matches or lighters. People must carry matches or lighters throughout the day in order to have a means for lighting a cigarette readily available. However, matches and lighters can easily be misplaced or lost, leaving a person without a way to light a cigarette. Carrying these additional items can also be inconvenient for people who already carry multiple items such as a wallet, cell phone, keys, and other items.

Further, matches and lighter fluid must be replaced as they are used, requiring the user to continually purchase new cigarette lighting supplies. The user must also find a place to dispose of a match after it has been used. Similarly, empty lighters must be thrown away and replaced periodically. If a trash receptacle is not available, people may simply litter and discard the match or lighter by throwing the match or lighter on the ground.

Another problem with conventional lighters and matches is that these items light a cigarette by creating an open flame that can be brought into contact with a cigarette. However, creating an open flame in cold and windy conditions may be difficult, causing the person to become frustrated as he or she attempts to light a cigarette. Further, the open flame creates the risk that a user may burn himself or herself while attempting to light the cigarette.

The present invention provides a cell phone cover having an integrated cigarette lighter. The cell phone cover comprises a housing that is substantially rectangular and is adapted to receive a cell phone therein. The housing further comprises an enclosed volume in which a control circuit having a supplemental battery is positioned. A lighting port is disposed on the housing and the lighting port includes a heating element that can be electrically heated in order to light a cigarette. The lighting port is powered by means of the supplemental battery, and the user can heat the heating element within the lighting port by operating one or more lighting port controls positioned on the housing. The cell phone cover is constructed of a flame-retardant, heat-resistant material that will not be adversely affected by the heat produced by the lighting port. The cell phone cover also has an adapter for connection to a cell phone positioned within the cell phone cover, and a port that allows a cell phone positioned within the cell phone cover to be externally charged by a conventional cell phone charger.

2. Description of the Prior Art

Devices have been disclosed in the prior art that relate to combination devices including a cigarette lighter feature. These include devices that have been patented and published in patent application publications. These devices generally relate to cell phones having integrated cigarette lighters. The following is a list of devices deemed most relevant to the present disclosure, which are herein described for the purposes of highlighting and differentiating the unique aspects of the present invention, and further highlighting the drawbacks existing in the prior art.

One such device in the prior art is U.S. Pat. No. 8,014,822 to Murray et al. which discloses an all in one device comprising a cell phone, a cigarette lighter, and a flashlight. The device resembles a cell phone and comprises an activation button to operate a heating element disposed in a combustion chamber. A piezoelectric igniter is used to ignite a flammable material within a reservoir, such as butane or propane. Thus, Murray et al. does not disclose a cell phone cover having a lighting port comprising a heating element that can be heated in order to light a cigarette. Instead, Murray et al. discloses a fuel-based lighter disposed inside of a cell phone.

U.S. Pat. No. 7,373,183 to Brudos discloses a cell phone having a lighter integrated therein. The device comprises an ignition mechanism providing a heat source that is sufficient to ignite a flammable element. The device may function similarly to a conventional butane lighter, and the device may comprise a fuel reservoir positioned within the housing of the cell phone. Thus, Brudos fails to disclose a cell phone cover having a cigarette lighter disposed thereon. Further, Brudos does not disclose a cigarette lighter that utilizes an electrical heating element, such as a metal coil, to light a cigarette.

U.S. Pat. No. 7,494,239 to Riccardi discloses an attachment for cell phones comprising a bottle opener and a light. The attachment can be attached to the back of a cell phone or cell phone case. The attachment can be secured to the back of a cell phone by means of a hook and loop fastener such as Velcro. Thus, Riccardi discloses a multi-function attachment for cell phones, but fails to disclose a cell phone cover having a cigarette lighter integrated therein.

U.S. Patent Application Publication No. 2005/0218137 to Sela et al. discloses a portable hand-held electric cigarette lighter. The lighter uses an electrical resistance heating element connected to an electromechanical circuit. The lighter may be powered by an externally located power source or by a built-in power source. Thus, the device disclosed by Sela et al. is not adapted for securement to a cell phone, and is not adapted to serve as a cell phone cover.

Finally, U.S. Pat. No. 4,816,971 to Chin discloses a flashlight having a built-in lighter. The cigarette lighter comprises a heat-resistant pad that has a groove at the center with a heating wire placed therein. A switch is used to control the heating of the heating wire for lighting a cigarette. Thus, Chin fails to disclose a cell phone cover having a cigarette lighter integrated therein. Instead, Chin discloses a combination flashlight and cigarette lighter.

These prior art devices have several known drawbacks. Several devices in the prior art disclose a cigarette lighter incorporated into the body of a cell phone. This arrangement is undesirable as the user is required to purchase a particular style and type of cell phone having the built-in lighter. These devices do not allow a user to use an existing cellphone. Further, integrating a cigarette lighter into a cell phone adds to the size and weight of the cell phone, which is undesirable.

Modern cell phones and smartphones are designed to have a slim profile and a large touch screen or viewing screen. As such, it is unappealing to incorporate a lighter into the cell phone itself. Other devices in the prior art disclose cell phones having cigarette lighters wherein the lighter operates by igniting a flammable material, such as butane. These devices are undesirable in that the fuel depletes with use, and must be periodically refilled. Further, the reservoir used to store the butane adds significant volume to the cell phone, requiring the cell phone's size to increase to accommodate the reservoir.

In light of the devices disclosed in the prior art, it is submitted that the present invention substantially diverges in design elements from the prior art and consequently it is clear that there is a need in the art for an improvement to existing cigarette lighting devices for use with cell phones. In this regard the instant invention substantially fulfills these needs.

SUMMARY OF THE INVENTION

In view of the foregoing disadvantages inherent in the known types of cigarette lighting devices now present in the prior art, the present invention provides a new cell phone cover having an integrated cigarette lighter wherein the same can be utilized for providing convenience for the user when lighting a cigarette.

It is therefore an object of the present invention to provide a new and improved cigarette lighting device that has all of the advantages of the prior art and none of the disadvantages.

It is another object of the present invention to provide a cell phone cover having an integrated cigarette lighter that eliminates the need for a user to carry matches, butane lighters, or other similar cigarette lighting devices, and that does not need to be refilled or otherwise replaced.

Another object of the present invention is to provide a cell phone cover having an integrated cigarette lighter that can be powered by a battery disposed within the cell phone cover.

Yet another object of the present invention is to provide a cell phone cover having an integrated cigarette lighter that providers a user with convenient access to a cigarette lighter.

An additional object of the present invention is to provide a cell phone covering having an integrated cigarette lighter that can easily be used by adults but that is difficult for children to operate in order to increase the safety of the use of the cigarette lighter.

Another object of the present invention is to provide a cell phone cover having an integrated cigarette lighter that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figures 1A, 1B:
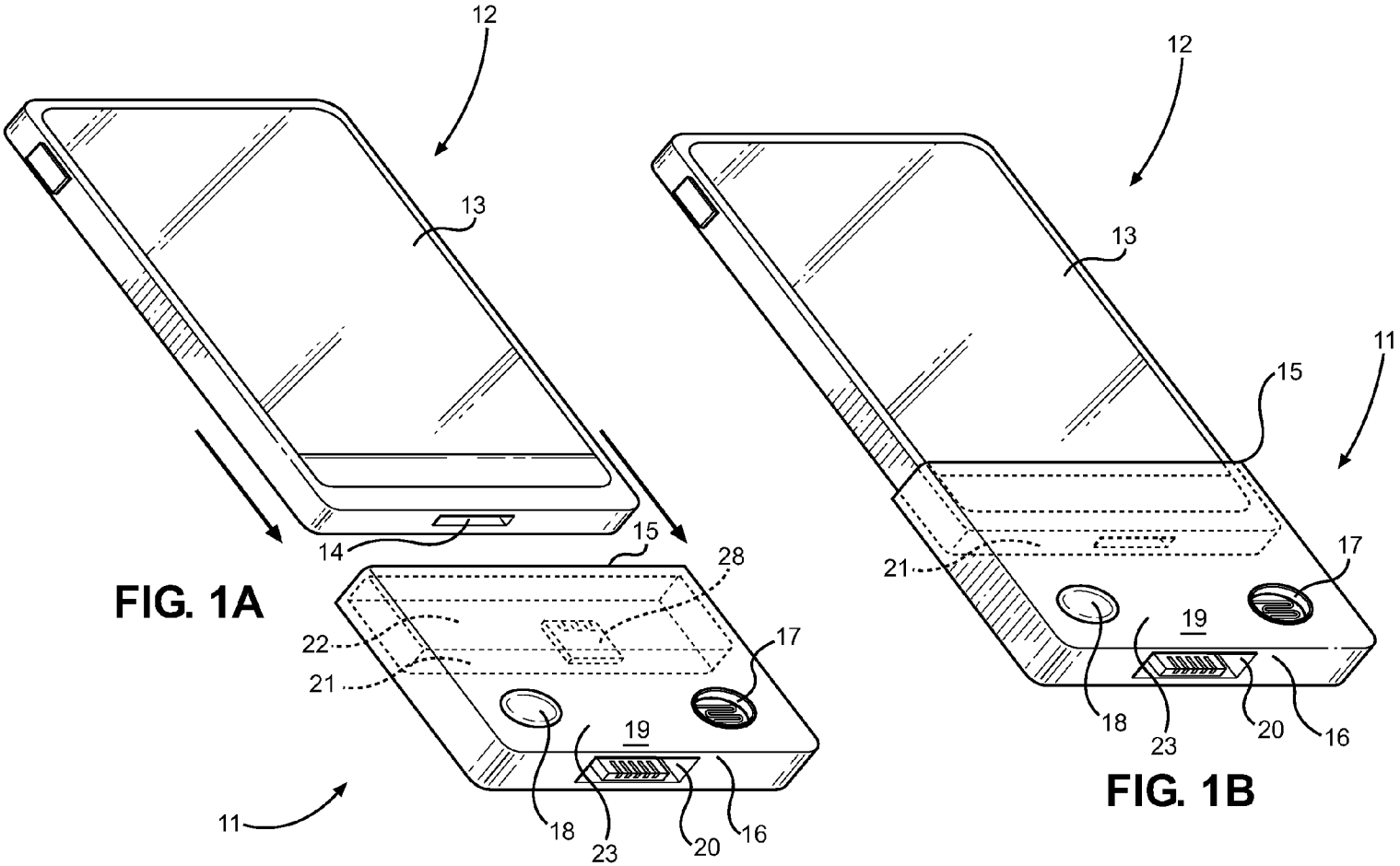
FIG. 1A shows a view of an embodiment of the cell phone cover having an integrated lighter of the present invention.
FIG. 1B shows a view of an embodiment of the cell phone cover having an integrated lighter of the present invention with a cell phone secured therein.

Reference is made herein to the attached drawings. Like reference numerals are used throughout the drawings to depict like or similar elements of the cell phone cover having an integrated cigarette lighter. For the purposes of presenting a brief and clear description of the present invention, the preferred embodiment will be discussed as used for holding a cell phone therein and lighting a cigarette. The figures are intended for representative purposes only and should not be considered to be limiting in any respect.

Referring now to FIGS. 1A and 1B, there are shown views of an embodiment of a cell phone cover having an integrated lighter with a cell phone secured therein. In the illustrated embodiment, the cell phone cover 11 comprises a housing having a front 19, a back, a lower end 16, a pair of sidewalls connecting the front 19 and the back, and an open upper end 15. The housing of the cell phone cover 11 comprises a substantially rectangular shape so as to closely fit to the shape of the cell phone 12. In some embodiments of the present invention, the cell phone cover 11 has a concave curvature at the upper end on the front and on the back. In this way, the cell phone cover 11 may grasp the sides of the cell phone, while leaving the screen 13 of the cell phone 12 substantially exposed.

In the illustrated embodiment, the cell phone cover 11 is secured to and covers only a lower portion of the cell phone 12. The cell phone cover 11 is held securely on the cell phone 12, but does not obscure or interfere with the screen 13 of the cell phone 12. The cell phone cover 11 is secured to the cell phone 12 by frictional engagement with the cell phone. The cell phone cover 11 is adapted to securely fit on a cell phone 12 so that the cell phone cover 11 does not slide off of the cell phone 12 once installed thereon.

The housing of the cell phone cover 11 further comprises an internal dividing wall 21 that separates an interior volume 22 in which a cell phone 12 can be positioned, from an enclosed volume 23 on a bottom portion of the cell phone cover 11. A cell phone 12 can be positioned within the interior volume 22 of the housing through the open upper end 15 as shown in FIG. 1A. The interior volume 22 includes an adapter 28 therein that extends from the internal dividing wall 21, and that can plug into the female input 14 on a cell phone 12. In some embodiments of the present invention, the adapter 28 comprises a male USB adapter capable of being inserted into a female USB input of a cell phone. In this way, the cell phone 12 positioned within the cell phone cover 11 can be electrically connected to the control circuit within the enclosed volume 23.

The housing of the cell phone cover 11 additionally comprises a USB input port 20 on the lower end 16 thereof, to which a user may attach a cell phone charger or a cable that connects the cell phone to a computer. Thus, the USB input port 20 allows the user to operably connect the cell phone 12 positioned therein to external devices and also allows the cell phone battery to be recharged. The USB input port 20 also allows a supplemental battery positioned within the enclosed volume 23 to be recharged in the same fashion.

The cell phone cover 11 comprises a lighting port 17 thereon and at least one lighting port control 18. The lighting port 17 and lighting port control 18 can be positioned in various locations on the housing. For example, the lighting port 17 and lighting port control 18 can be positioned on the front, the sidewalls, or the back of the housing. Further, the lighting port 17 and lighting port control 18 may be positioned on separate areas of the housing. For example, the lighting port 17 may be on the back of the housing, while the lighting port control 18 may be on the side of the housing.

The lighting port 17 includes a circular opening on the exterior of the cell phone cover 11 in which a heating element is disposed. In a preferred embodiment of the present invention, the heating element is a thin coil of wire composed of a material having a high melting temperature, such as nichrome. The lighting port control 18 allows user to selectively power the lighting port 17, and the lighting port control 18 may comprise any suitable means to achieve this purpose including, but not limited to, a push button or a switch. In some embodiments of the present invention, a first and second lighting port control 18 are used, such that a user must simultaneously operate both the first and second lighting port controls 18 in order to heat the lighting port 17. This helps to prevent operation of the cigarette lighter by a child, because children may be unable to grasp the cell phone cover in the manner required to simultaneously operate a first and second lighting port control.

Once the user operates the one or more lighting port controls 18 such that the heating element within the lighting port 17 is heated, a user can light a cigarette by contacting the cigarette with the heating element within the lighting port 17. In some embodiments of the present invention, the lighting port 17 comprises a removable cover thereon that can be used to cover or uncover the lighting port 17 as desired by the user. The cover can be slidably positioned on the housing such that a user can slide the cover into place over the lighting port 17 in order to cover the lighting port 17, or the user can slide the cover so as to expose the lighting port 17. In this way, the cover protects the heating element from contacting external surfaces when the lighting port 17 is not in use, and the cover helps to prevent a user from accidentally contacting the heating element, which could cause the user to burn himself or herself.

The cell phone cover 11 is composed of a heat-resistant, non-flammable material that will not melt or otherwise be damaged from the heat generated by the lighting port 17. In some embodiments, the portion of the cover surrounding the lighting port 17 comprises a protective material that prevents heat produced by the lighting port 17 from being transferred to the cell phone 12. An insulating material can be used to prevent heat transfer to the cell phone 12 within the cell phone cover 11. If the cell phone cover 11 is not composed of a heat-resistant material, heat from the lighting port 17 may burn, melt, or otherwise damage the cell phone cover and the cell phone held therein.

Figure 2:
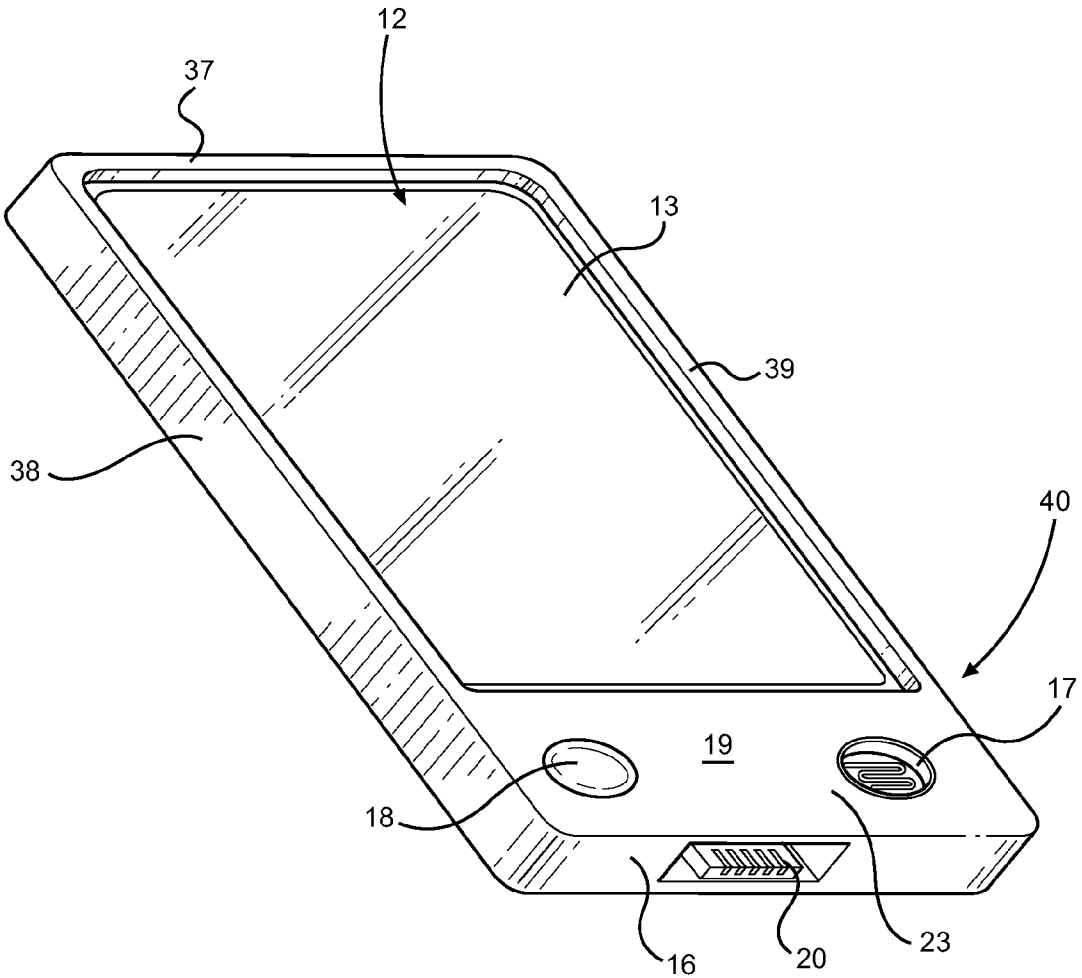
FIG. 2 shows a view of an embodiment of the cell phone cover that extends substantially along the entire body of the cell phone.

Referring now to FIG. 2, there is shown a view of an embodiment of the cell phone cover that extends substantially along the entire body of the cell phone. In the illustrated embodiment of the cell phone cover 40 of the present invention, differs from the embodiment shown in FIGS. 1A and 1B, only in that the cover fully encloses the cell phone therein, similar to traditional cell phone covers. In the embodiment shown in FIG. 2, the cell phone is inserted into an interior volume, and the power source and control circuit are disposed within the enclosed volume. However, the embodiment shown fully encloses a cell phone therein, and the back of the housing extends along the back of the cell phone so as to cover the entirety thereof. The housing further comprises elongated side portions 38,39 that cover the sides of the cell phone, and a top portion 37 that covers the top of the cell phone. In this way, the cell phone cover 40 wraps around the perimeter of the cell phone to provide protection to the cell phone. The housing extends partially onto the surface of the cell phone so as to maintain the cell phone in position within the housing. The side portions 38,39 and top 37 of the housing do not extend onto the screen of a cell phone inserted therein. In this way, a cell phone positioned within the housing is substantially enclosed, but the screen is left exposed so as to not interfere with the user's ability to use and operate the cell phone.

In the embodiment wherein the cell phone cover substantially encloses the cell phone therein, the portion of the housing that surrounds the cell phone is composed of a durable, flexible material. In this way, the cell phone cover can be temporarily bent or deformed in order to easily insert the cell phone therein. The enclosed volume of the housing is composed of a rigid material so as to protect the circuit components therein.

Figure 3:
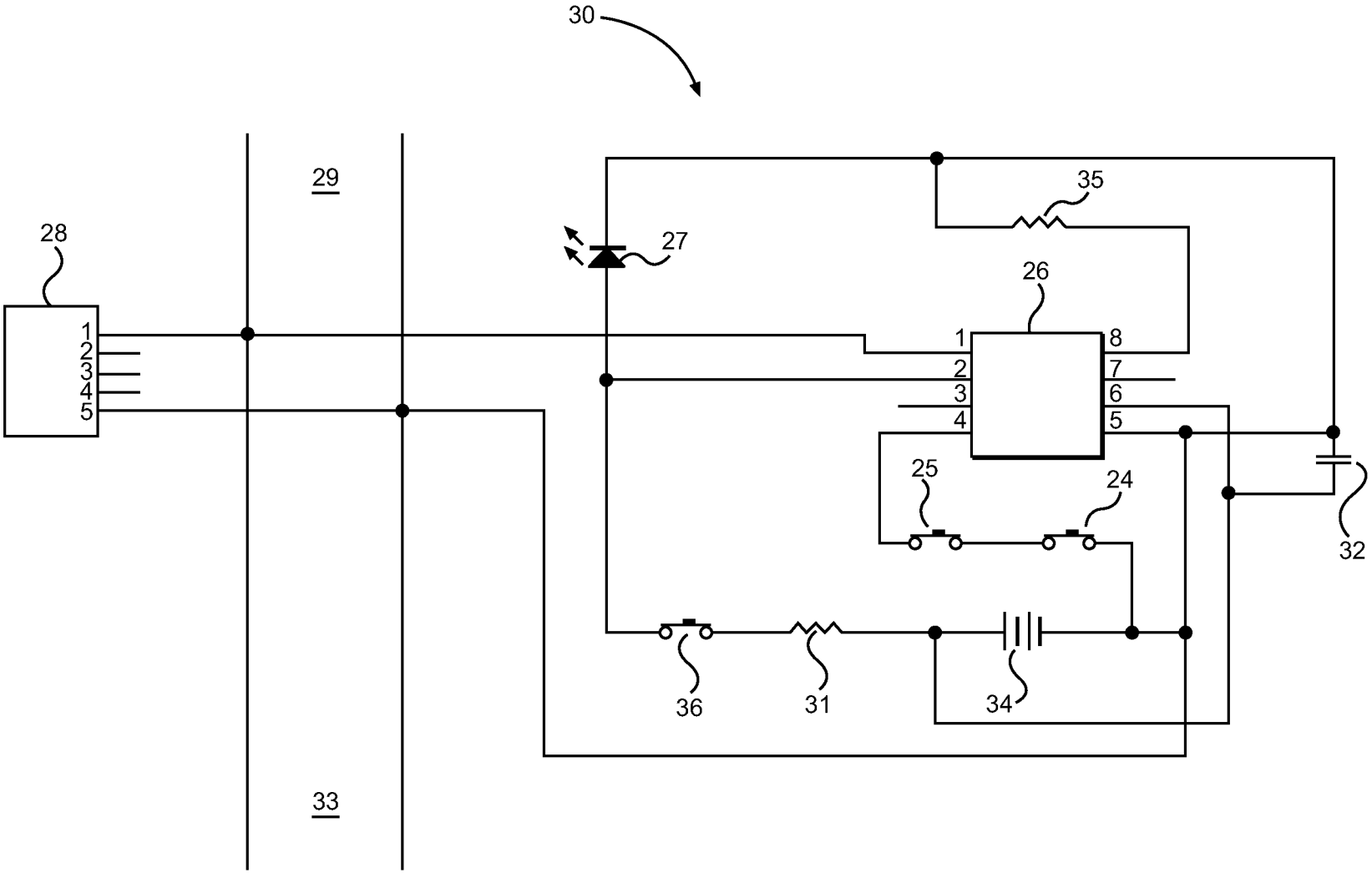
FIG. 3 shows a schematic diagram of an embodiment of the control circuit of the cigarette lighter of the present invention.

Referring now to FIG. 3, there is shown a schematic diagram of an embodiment of the control circuit of the cigarette lighter of the present invention. The control circuit 30 comprises a supplemental battery 34, a heating element 35, a switch 24, a microchip 26, and a USB port. A supplemental battery 34 is provided as a power source for the heating element 35 within the lighting port. The supplemental battery 34 may comprise a rechargeable battery. While the supplemental battery 34 is primarily used to power the heating element 35, the supplemental battery 34 could also be used in order to provide power to the cell phone if the cell phone's battery is not charged. A cell phone positioned within the cell phone cover is connected to the control circuit 30 by means of an adapter 28 positioned within the interior volume of the cell phone cover. The adapter 28 is inserted into the input on the cell phone, as shown in FIG. 1A.

The switch 24 allows a user to selectively complete the circuit in order to provide electricity to, and thus heat, the heating element 35. In operation, the user operates a lighting port control, which causes the first switch 24 to complete the circuit, allowing electricity to flow from the supplemental battery 34 to the heating element 35. The heating element 35 is a resistance heating element such that the temperature of the heating element 35 increases as electricity flows therethrough. In some embodiments of the present invention, the device further includes a second switch 25 corresponding to a second lighting port control that is disposed on a sidewall of the cell phone cover. The second switch 25 is required to be operated at the same time as the first switch 24. Thus, the user must operate both lighting port controls simultaneously in order to heat the heating element 35. The addition of the second switch 25 is a safety feature which inhibits use of the lighting port by a child. A child, having small hands relative to an adult, may find it difficult to wrap his or her hand around the cell phone cover and operate both lighting port controls as required to light a cigarette. However, an adult would not have any difficulty operating both controls simultaneously.

The control circuit 30 also includes a microchip 26 that functions as a timer, which serves as a safety mechanism. The microchip 26 limits the amount of time that the heating element 35 is heated, preventing electricity from continuing to flow through the circuit after a certain period of time elapses. This prevents users from unintentionally allowing the heating element 35 to continue heating for an extended period of time, which may result in damage to the cell phone cover, the user's cell phone, and even to the user. The control circuit 30 may include additional circuit components as needed to improve the safety, efficiency, and durability of the control circuit. For example, the circuit 30 may include a chip bypass capacitor 32 that functions as a power supply filter.

The control circuit 30 comprises a battery charging connector 33 that is adapted to connect to a battery charging device or a cable for such a device. The battery charging connector 33 allows a user to charge a cell phone positioned within the cell phone cover of the present invention without having to remove the cell phone therefrom. Thus, the user can insert a conventional charger into the battery charging connector 33 to charge his or her cell phone in the ordinary manner. The battery charging connector 33 allows for high current to flow therethrough to provide fast recharging of the cell phone's battery or batteries.

The control circuit 30 further comprises a USB adapter 29 adapted to allow for data connection between a personal computer or related device and a cell phone positioned within the cell phone case. The USB adapter 29 is accessible from the exterior of the cell phone cover of the present invention. The USB adapter 29 allows a user to transfer data between his or her laptop, desktop, or related device, and his or her cell phone. In a preferred embodiment of the present invention, the battery charging connector 33 and the USB adapter 29 are embodied in a single USB port 20 disposed on the lower end of the cell phone cover, as shown in FIGS. 1A and 1B.

In some embodiments of the present invention, the control circuit 30 also includes an LED light 27 that is adapted to function as a flashlight. In such embodiments, a current limiting resistor 31 is connected in series to the LED light 27 to limit the current supplied thereto, in order to protect the LED light from overcurrent faults. Further, an LED switch 36 is provided such that the user can selectively turn the LED light 27 on or off by actuating the LED switch 36. The LED light 27 is exposed on the exterior of the cell phone cover of the present invention, and the cell phone cover additionally includes the LED switch 36 thereon such that the user can easily turn the flashlight on or off.

The present invention provides a cell phone cover having an integrated cigarette lighter. The cell phone cover is adapted to receive a cell phone therein, and comprises an enclosed region in which a supplemental battery and a control circuit are positioned. The cell phone cover comprises a lighting port positioned thereon that is operated by at least one lighting port control that is also disposed on the cell phone cover. The control circuit comprises a microchip that limits the amount of time the lighting port is heated, so as to prevent the lighting port from overheating, or from being accidentally heated for an extended period of time. Additionally, the cell phone cover allows the cell phone therein to be charged in the conventional fashion, without having to remove the cellphone therefrom.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cell phone cover having an integrated lighter, comprising:

a housing having a front, a back, sidewalls, a lower end, an open upper end, and a dividing wall extending from said front to said back and defining an interior volume in which a cell phone can be positioned through said open upper end such that a lower end of said cell phone rests against said dividing wall, and an enclosed volume that is separated from said interior volume by said dividing wall;

a lighting port rigidly disposed on said housing, wherein said lighting port is adapted to light a cigarette;

a first lighting port control disposed on said housing, wherein said first lighting port control is adapted to allow a user to operate said lighting port;

a control circuit comprising a power source for powering said lighting port, wherein said control circuit electrically connects said lighting port and said lighting port control, wherein said control circuit is disposed within said enclosed volume of said housing.

2. The cell phone cover of claim 1, wherein said housing is substantially rectangular.

3. The cell phone cover of claim 1, wherein said interior volume of said housing comprises a cell phone adapter therein, and wherein said cell phone adapter is adapted to be inserted into a cell phone such that said cell phone is electrically connected to said control circuit by means of said cell phone adapter.

4. The cell phone cover of claim 3, wherein said housing further comprises a USB port disposed on said lower end;

wherein said USB port is adapted to receive a cell phone charger therein, such that a battery of said cell phone disposed within said housing can be charged by electrically connecting said cell phone charger to said USB port.

5. The cell phone cover of claim 1, wherein said lighting port comprises a heating element therein.

6. The cell phone cover of claim 5, wherein said heating element is a coil of wire.

7. The cell phone cover of claim 1, wherein said control circuit further comprises:

a switch operable by said lighting port control, a heating element disposed within said lighting port, and a microchip.

8. The cell phone cover of claim 7, wherein said microchip allows said heating element to be heated for a predetermined period of time.

9. The cell phone cover of claim 7, further comprising a second lighting port control on said housing;

wherein said second lighting port control and said first lighting port control must be simultaneously operated in order to heat said heating element.

10. The cell phone cover of claim 1, wherein said control circuit further comprises an LED light that is adapted to be used as a flashlight, a switch that allows a user to selectively turn the LED light on or off;

wherein said LED light is disposed on said housing.

11. The cell phone cover of claim 1, wherein said lighting port comprises a movable cover thereon, such that the lighting port can be selectively covered or exposed.

12. The cell phone cover of claim 1, wherein said housing is composed of a flame-retardant material.

13. The cell phone cover of claim 1, wherein said sidewalls of said housing extend along a cell phone so that said housing substantially encloses a cell phone therein.

14. The cell phone cover of claim 1, wherein said lighting port is disposed on said back of said housing.

15. The cell phone cover of claim 1, wherein said first lighting port control is disposed on said back of said housing.

16. A cell phone cover having an integrated lighter, comprising:

a housing having a front, a back, sidewalls, a lower end, an open upper end, and a dividing wall extending from said front to said back and defining an interior volume in which a cell phone can be positioned through said open upper end such that a lower end of said cell phone rests against said dividing wall, and an enclosed volume that is separated from said interior volume by said dividing wall;

a lighting port rigidly disposed on said housing, wherein said lighting port is adapted to light a cigarette;

a first lighting port control disposed on said housing, wherein said first lighting port control is adapted to allow a user to operate said lighting port;

a control circuit that electrically connects said lighting port and said lighting port control, wherein said control circuit is disposed within said enclosed volume of said housing;

said interior volume of said housing comprising a cell phone adapter therein, wherein said cell phone adapter is adapted to be inserted into a cell phone such that said cell phone is electrically connected to said control circuit by means of said cell phone adapter;

a charging port disposed on said lower end of said housing, wherein said charging port is adapted to receive a cell phone charger therein, such that a battery of said cell phone connected to said cell phone adapter can be charged by electrically connecting said cell phone charger to said charging port.

* * * * *